US010793803B2

(12) United States Patent
Kusumoto

(10) Patent No.: US 10,793,803 B2
(45) Date of Patent: Oct. 6, 2020

(54) GASOLINE ENGINE LUBRICANT OIL COMPOSITION AND MANUFACTURING METHOD THEREFOR

(71) Applicant: IDEMITSU KOSAN CO., LTD., Chiyoda-ku (JP)

(72) Inventor: Tatsuya Kusumoto, Chiba (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 15/320,540

(22) PCT Filed: Mar. 31, 2016

(86) PCT No.: PCT/JP2016/060719
§ 371 (c)(1),
(2) Date: Dec. 20, 2016

(87) PCT Pub. No.: WO2016/159258
PCT Pub. Date: Oct. 6, 2016

(65) Prior Publication Data

US 2017/0198235 A1 Jul. 13, 2017

(30) Foreign Application Priority Data

Mar. 31, 2015 (JP) ..... 2015-074359

(51) Int. Cl.

| | |
|---|---|
| ***C10M 169/04*** | (2006.01) |
| ***C10M 163/00*** | (2006.01) |
| ***C10M 167/00*** | (2006.01) |
| ***C10M 141/08*** | (2006.01) |
| *C10N 30/02* | (2006.01) |
| *C10N 30/04* | (2006.01) |
| *C10N 30/06* | (2006.01) |
| *C10N 30/00* | (2006.01) |
| *C10N 40/25* | (2006.01) |
| *C10N 60/14* | (2006.01) |

(52) U.S. Cl.
CPC ..... *C10M 169/04* (2013.01); *C10M 141/08* (2013.01); *C10M 163/00* (2013.01); *C10M 167/00* (2013.01); *C10M 2203/003* (2013.01); *C10M 2203/1025* (2013.01); *C10M 2205/0285* (2013.01); *C10M 2207/262* (2013.01); *C10M 2209/084* (2013.01); *C10M 2215/223* (2013.01); *C10M 2215/28* (2013.01); *C10M 2219/046* (2013.01); *C10M 2219/068* (2013.01); *C10M 2223/045* (2013.01); *C10N 2030/02* (2013.01); *C10N 2030/04* (2013.01); *C10N 2030/06* (2013.01); *C10N 2030/54* (2020.05); *C10N 2040/25* (2013.01); *C10N 2040/255* (2020.05); *C10N 2060/14* (2013.01)

(58) Field of Classification Search
CPC ..... C10M 169/04; C10M 2215/086; C10M 2215/28; C10M 2219/068; C10M 141/08; C10M 163/00; C10M 167/00; C10M 2203/003; C10M 2203/1025; C10M 2205/0285; C10M 2207/262; C10M 2209/084; C10M 2215/223; C10M 2219/04; C10M 2223/045; C10N 2210/02; C10N 2230/04; C10N 2230/06; C10N 2230/54; C10N 2240/10; C10N 2240/104; C10N 2260/14; C10N 2030/02; C10N 2030/04; C10N 2030/06; C10N 2030/54; C10N 2040/25; C10N 2040/256; C10N 2060/14
See application file for complete search history.

(56) References Cited

U.S. PATENT DOCUMENTS

| | | | |
|---|---|---|---|
| 5,658,862 | A | 8/1997 | Vrahopoulou |
| 6,051,536 | A | 4/2000 | Igarashi et al. |
| 6,245,725 | B1 | 6/2001 | Tanaka et al. |

(Continued)

FOREIGN PATENT DOCUMENTS

| | | | |
|---|---|---|---|
| CN | 1782048 | A | 6/2006 |
| CN | 101184830 | A | 5/2008 |

(Continued)

OTHER PUBLICATIONS

Japanese Office Action dated Feb. 7, 2017 in Patent Application No. 2016-547964 (without English Translation).
International Search Report dated May 10, 2016 in PCT/JP2016/060719 filed Mar. 31, 2016.
Notice of Opposition issued Apr. 6, 2018, in Japanese U.S. Pat. No. 6,197,123.
Supplemental European Search Report dated Jul. 24, 2018, in European Patent Application No. 16773138.9 filed Mar. 31, 2016.
Extended European Search Report dated Jun. 17, 2019 in European Patent Application No. 19156155.4.

(Continued)

*Primary Examiner* — James C Goloboy
(74) *Attorney, Agent, or Firm* — Oblon, McClelland, Maier & Neustadt, L.L.P.

(57) ABSTRACT

Provided is a lubricating oil composition capable of revealing fuel consumption reducing properties due to a friction reducing effect within a short period of time while having excellent fuel consumption reducing properties, specifically a lubricating oil composition of the present invention includes a base oil, a molybdenum dithiocarbamate, a calcium detergent, a magnesium detergent, and a boron-free succinimide, wherein the content of the molybdenum dithiocarbamate as converted into a molybdenum atom is 1,200 ppm by mass or less on a basis of the whole amount of the composition; the content of the boron-free succinimide as converted into a nitrogen atom is less than 1,200 ppm by mass on a basis of the whole amount of the composition; and a mass ratio of the molybdenum atom (Mo) to a magnesium atom (Mg) of the magnesium detergent [Mo/Mg] is 0.1 or more.

19 Claims, No Drawings

(56) References Cited

U.S. PATENT DOCUMENTS

| | | | | |
|---|---|---|---|---|
| 7,820,599 | B2 * | 10/2010 | Kasai | C10M 163/00 508/192 |
| 2003/0148895 | A1 * | 8/2003 | Robson | C10M 141/12 508/155 |
| 2005/0043191 | A1 * | 2/2005 | Farng | C10M 161/00 508/185 |
| 2006/0068999 | A1 | 3/2006 | Shaw et al. | |
| 2006/0116299 | A1 * | 6/2006 | Arrowsmith | C10M 163/00 508/443 |
| 2007/0287643 | A1 * | 12/2007 | Matsui | C10M 101/02 508/363 |
| 2009/0082233 | A1 | 3/2009 | Kasai | |
| 2010/0029520 | A1 | 2/2010 | Kamano | |
| 2010/0075875 | A1 | 3/2010 | Yaguchi | |
| 2013/0196888 | A1 | 8/2013 | Truong-Dinh | |
| 2013/0310289 | A1 * | 11/2013 | Umehara | C10M 135/18 508/363 |
| 2014/0034003 | A1 | 2/2014 | Corradi et al. | |

FOREIGN PATENT DOCUMENTS

| | | | | |
|---|---|---|---|---|
| JP | 62-215697 | A | | 9/1987 |
| JP | 5-279686 | A | | 10/1993 |
| JP | 7-316577 | A | | 12/1995 |
| JP | 8-209178 | A | | 8/1996 |
| JP | 9-263782 | A | | 10/1997 |
| JP | 10053784 | A | * | 2/1998 |
| JP | 10-510876 | A | | 10/1998 |
| JP | 2000-192068 | A | | 7/2000 |
| JP | 2003-041283 | A | | 2/2003 |
| JP | 2005-162968 | A | | 6/2005 |
| JP | 2006-097027 | A | | 4/2006 |
| JP | 2006-152305 | A | | 6/2006 |
| JP | 2006-328265 | A | | 12/2006 |
| JP | 2007-505168 | A | | 3/2007 |
| JP | 2008-106199 | A | | 5/2008 |
| JP | 2008-120908 | A | | 5/2008 |
| JP | 2011-12213 | A | | 1/2011 |
| JP | 2012-036344 | A | | 2/2012 |
| JP | 2012-102280 | A | | 5/2012 |
| JP | 2013-536293 | A | | 9/2013 |
| JP | 2014-031515 | A | | 2/2014 |
| JP | 2014-210844 | A | | 11/2014 |
| WO | 96/37582 | | | 11/1996 |
| WO | 2015/114920 | A1 | | 8/2015 |
| WO | 2016/152993 | A1 | | 9/2016 |
| WO | 2017/099052 | A1 | | 6/2017 |

OTHER PUBLICATIONS

Office Action dated Nov. 27, 2019, in Indian Patent Application No. 201747033814 (with English translation).

Office Action dated Aug. 26, 2019, in Chinese Patent Application No. 201680001817.8 (filed Mar. 31, 2016).

Office Action in CN Application No. 201680001817.8, dated Apr. 2, 2020 (w/English Translation).

Office Action in U.S. Appl. No. 16/267,495, dated Apr. 8, 2019.

Office Action in U.S. Appl. No. 16/267,495, dated Dec. 19, 2019.

Office Action in U.S. Appl. No. 16/267,495, dated Jul. 17, 2020.

* cited by examiner

GASOLINE ENGINE LUBRICANT OIL COMPOSITION AND MANUFACTURING METHOD THEREFOR

TECHNICAL FIELD

The present invention relates to a lubricating oil composition for a gasoline engine and a method for producing the same.

BACKGROUND ART

At present, the environmental regulations on a global scale are becoming strict more and more, and the situation surrounding automobiles is getting strict from the sides of fuel economy regulations, exhaust gas regulations, and so on. In this background, there are environmental issues regarding global warming, etc. and resource protection in view of a concern regarding depletion of oil resources, and fuel consumption reduction on automobiles is an urgent need. In order to improve the fuel consumption reduction on automobiles, the development of a miniaturization technology of engine and the market expansion are advanced, and weight saving of an automobile becomes possible. Thus, a large contribution to improvements in fuel consumption performance is expected.

There has hitherto been made an attempt of adoption of a molybdenum dithiocarbamate (MoDTC) as an anti-wear agent for a lubricating oil composition that is used for gasoline engines, diesel engines, and so on to reduce a metal-to-metal friction coefficient, thereby improving fuel consumption reducing properties (see, for example, PTL 1).

CITATION LIST

Patent Literature

PTL 1: JP 2008-120908 A

SUMMARY OF INVENTION

Technical Problem

However, on the occasion of reducing a metal-to-metal friction coefficient to improve fuel consumption reducing properties, though the molybdenum dithiocarbamate (MoDTC) functions as an excellent anti-wear agent, it involved such a problem that a reaction film with low friction is formed on a metal surface, so that it takes a time for obtaining an effect for reducing the friction coefficient. For that reason, according to the lubricating oil composition disclosed in PTL 1, the foregoing problem could not be overcome. Thus, a lubricating oil composition that reveals an effect for reducing a friction coefficient within a short period of time while having fuel consumption reducing properties was demanded.

In view of the aforementioned circumstances, the present invention has been made, and an object thereof is to provide a lubricating oil composition capable of revealing fuel consumption reducing properties due to a friction reducing effect within a short period of time while maintaining excellent fuel consumption reducing properties.

Solution to Problem

The present inventor made extensive and intensive investigations. As a result, it has been found that the aforementioned problem can be solved by the following invention. Specifically, the present invention provides a lubricating oil composition having the following constitution and a method for producing the same.

[1] A lubricating oil composition including a base oil, a molybdenum dithiocarbamate, a calcium detergent, a magnesium detergent, and a boron-free succinimide, wherein the content of the molybdenum dithiocarbamate as converted into a molybdenum atom is 1,200 ppm by mass or less on a basis of the whole amount of the composition, the content of the boron-free succinimide as converted into a nitrogen atom is less than 1,200 ppm by mass on a basis of the whole amount of the composition, and a mass ratio of the molybdenum atom (Mo) to a magnesium atom (Mg) of the magnesium detergent [Mo/Mg] is 0.1 or more.

[2] A method for producing a lubricating oil composition including blending a base oil with a molybdenum dithiocarbamate, a calcium detergent, a magnesium detergent, and a boron-free succinimide, such that the content of the molybdenum dithiocarbamate as converted into a molybdenum atom is 1,200 ppm by mass or less on a basis of the whole amount of the composition, the content of the boron-free succinimide as converted into a nitrogen atom is less than 1,200 ppm by mass on a basis of the whole amount of the composition, and a mass ratio of the molybdenum atom (Mo) to a magnesium atom (Mg) of the magnesium detergent [Mo/Mg] is 0.1 or more.

Advantageous Effects of Invention

The lubricating oil composition of the present invention is able to reveal fuel consumption reducing properties due to a friction reducing effect within a short period of time while having excellent fuel consumption reducing properties.

DESCRIPTION OF EMBODIMENTS

The lubricating oil composition of the present invention includes a base oil, a molybdenum dithiocarbamate, a calcium detergent, a magnesium detergent, and a boron-free succinimide, wherein the content of the molybdenum dithiocarbamate as converted into a molybdenum atom is 1,200 ppm by mass or less on a basis of the whole amount of the composition; the content of the boron-free succinimide as converted into a nitrogen atom is less than 1,200 ppm by mass on a basis of the whole amount of the composition; and a mass ratio of the molybdenum atom (Mo) to a magnesium atom (Mg) of the magnesium detergent [Mo/Mg] is 0.1 or more.

(Base Oil)

The base oil that is contained in the lubricating oil composition of the present invention may be either a mineral oil or a synthetic oil, and a mixed oil of a mineral oil and a synthetic oil may also be used.

Examples of the mineral oil include atmospheric residues obtained by subjecting a crude oil, such as a paraffin base mineral oil, an intermediate base mineral oil, a naphthenic base oil, etc., to atmospheric distillation; distillates obtained by subjecting such an atmospheric residue to distillation under reduced pressure; mineral oils and waxes resulting from subjecting the distillate to one or more treatments of solvent deasphalting, solvent extraction, hydro-cracking, solvent dewaxing, catalytic dewaxing, hydrorefining, and the like.

Examples of the synthetic oil include a poly-α-olefin (also referred to as "PAO"), such as polybutene and an α-olefin homopolymer or copolymer (for example, a homopolymer or copolymer of an α-olefin having 8 to 14 carbon atoms, such as an ethylene-α-olefin copolymer, etc.), etc.; various esters, such as a polyol ester, a dibasic acid ester, a phosphate ester, etc.; various ethers, such as a polyphenyl ether, etc.; a polyglycol; an alkylbenzene; an alkylnaphthalene; a synthetic oil obtained by isomerizing a wax (GTL wax) produced by a Fischer-Tropsch process or the like; and the like.

Of those, from the viewpoint of detergency of the lubricating oil composition, at least one selected from a mineral oil and a synthetic oil which are classified into Groups 3 to 5 of the base stock categories of the API (American Petroleum Institute) is preferred.

In addition, in the present invention, from the viewpoints of improving detergency, fuel consumption reducing properties, and a performance capable of revealing fuel consumption reducing properties due to a friction reducing effect within a short period of time (also referred to as "fast-acting properties of fuel consumption reducing properties revealment"), a combination of a mineral oil classified into the Group 3 with a poly-α-olefin (PAO) is preferred.

A kinematic viscosity at 100° C. of the base oil is preferably 2 to 30 $mm^2/s$, and more preferably 2 to 15 $mm^2/s$. When the kinematic viscosity at 100° C. of the base oil is 2 $mm^2/s$ or more, an evaporation loss is small, whereas when it is 30 $mm^2/s$ or less, a power loss attributable to viscous resistance is not so large, and hence, a fuel consumption improving effect is obtained.

From the viewpoint of not only suppressing a change in viscosity attributable to a change in temperature but also improving the fuel consumption reducing properties, a viscosity index of the base oil is preferably 120 or more. In the case of using a mixed oil composed of a combination of two or more mineral oils and/or synthetic oils as the base oil, it is preferred that the kinematic viscosity and the viscosity index of the mixed oil fall within the aforementioned ranges.

The content of the base oil is preferably 55 mass % or more, more preferably 60 mass % or more, still more preferably 65 mass % or more, and especially preferably 70 mass % or more, and preferably 99 mass % or less, and more preferably 95 mass % or less relative to the whole amount of the lubricating oil composition.

In the case of using a combination of a mineral oil with a poly-α-olefin (PAO), the content of the poly-α-olefin is preferably 1 to 50 mass %, more preferably 1 to 30 mass %, and still more preferably 2 to 20 mass % relative to the whole amount of the lubricating oil composition.

(Molybdenum Dithiocarbamate)

The lubricating oil composition of the present invention includes a molybdenum dithiocarbamate (also referred to as "MoDTC"). The molybdenum dithiocarbamate functions as a friction modifier that reduces a metal-to-metal friction coefficient, whereby excellent fuel consumption reducing properties are obtained. As the molybdenum dithiocarbamate (MoDTC), a compound represented by the following general formula (1) is preferably exemplified.

(1)

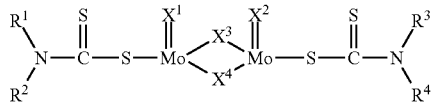

In the general formula (1), $R^1$ to $R^4$ each independently represent a hydrocarbon group having 5 to 18 carbon atoms, and $R^1$ to $R^4$ may be the same as or different from each other.

$X^1$ to $X^4$ each independently represent an oxygen atom or a sulfur atom, and $X^1$ to $X^4$ may be the same as or different from each other. From the viewpoint of improving the solubility in the base oil, a molar ratio of a sulfur atom to an oxygen atom [(sulfur atom)/(oxygen atom)] in $X^1$ to $X^4$ is preferably 1/3 to 3/1, and more preferably 1.5/2.5 to 3/1.

Examples of the hydrocarbon group represented by $R^1$ to $R^4$ include an alkyl group having 5 to 18 carbon atoms, such as a pentyl group, a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, an octadecyl group, etc.; an alkenyl group having 5 to 18 carbon atoms, such as an octenyl group, a nonenyl group, a decenyl group, an undecenyl group, a dodecenyl group, a tridecenyl group, a tetradecenyl group, a pentadecenyl group, etc.; a cycloalkyl group having 5 to 18 carbon atoms, such as a cyclohexyl group, a dimethylcyclohexyl group, an ethylcyclohexyl group, a methylcyclohexylmethyl group, a cyclohexylethyl group, a propylcyclohexyl group, a butylcyclohexyl group, a heptylcyclohexyl group, etc.; an aryl group having 6 to 18 carbon atoms, such as a phenyl group, a naphthyl group, an anthracenyl group, a biphenyl group, a terphenyl group, etc.; an alkylaryl group, such as a tolyl group, a dimethylphenyl group, a butylphenyl group, a nonylphenyl group, a methylbenzyl group, a dimethylnaphthyl group, etc.; an arylalkyl group having 7 to 18 carbon atoms, such as a phenylmethyl group, a phenylethyl group, a diphenylmethyl group, etc.; and the like. In the present invention, among the aforementioned hydrocarbon groups, those having 5 to 16 carbon atoms are preferred, and those having 5 to 12 carbon atoms are more preferred.

The content of the molybdenum dithiocarbamate (MoDTC) as converted into a molybdenum atom is 1,200 ppm by mass or less on a basis of the whole amount of the composition. When the content is 1,200 ppm by mass or less, since excellent wear resistance is obtained, excellent fuel consumption reducing properties are obtained, and a lowering of detergency can be suppressed. From the same viewpoints, the content of the molybdenum dithiocarbamate (MoDTC) is preferably 60 to 1,100 ppm by mass, more preferably 100 to 1,100 ppm by mass, still more preferably more than 200 ppm by mass and 1,100 ppm by mass or less, yet still more preferably 300 to 1,100 ppm by mass, and especially preferably 300 to 800 ppm by mass.

(Calcium Detergent)

The lubricating oil composition of the present invention includes a calcium detergent.

Examples of the calcium detergent include calcium salts of a sulfonate, a phenate, and a salicylate, and these can be used alone or in combination of plural kinds thereof. From the viewpoints of detergency and fuel consumption reducing properties, a calcium salt of a salicylate (calcium salicylate) is preferred.

Such a calcium detergent may be any of a neutral salt, a basic salt, and an overbased salt, and from the viewpoint of detergency, the calcium detergent is preferably a basic salt or an overbased salt. A total base number thereof is preferably 10 to 500 mgKOH/g, more preferably 150 to 500 mgKOH/g, still more preferably 150 to 450 mgKOH/g, yet still more preferably more than 300 mgKOH/g and 450 mgKOH/g or less, and especially preferably 310 to 400 mgKOH/g. Here, the total base number means one as measured in conformity with the perchloric acid method prescribed in JIS K2501.

The content of the calcium detergent as converted into a calcium atom is preferably 2,000 ppm by mass or less on a basis of the whole amount of the composition. When the content of the calcium detergent is 2,000 ppm by mass or less, excellent fuel consumption reducing properties and fast-acting properties of fuel consumption reducing properties revealment are obtained together with the detergency. From the same viewpoints, the content of the calcium detergent is preferably 1,000 to 2,000 ppm by mass, more preferably 1,000 to 1,500 ppm by mass, still more preferably 1,000 to 1,300 ppm by mass, and especially 1,000 ppm by mass or more and less than 1,300 ppm by mass.

The content as converted into a calcium atom in the lubricating oil composition is a value as measured in conformity with JIS-5S-38-92. In addition, the content of each of a magnesium atom, a sodium atom, a boron atom, a molybdenum atom, and a phosphorus atom as described later is also a value as measured in conformity with JIS-5S-38-92. In addition, the content as converted into a nitrogen atom means a value as measured in conformity with JIS K2609.

(Magnesium Detergent)

The lubricating oil composition of the present invention includes a magnesium detergent.

Examples of the magnesium detergent include magnesium salts of a sulfonate, a phenate, and a salicylate, and these can be used alone or in combination of plural kinds thereof. From the viewpoint of low friction properties, a magnesium salt of a sulfonate (magnesium sulfonate) is preferred.

From the viewpoint of detergency, the magnesium detergent is preferably a basic salt or an overbased salt. A total base number thereof is preferably 150 to 650 mgKOH/g, more preferably 150 to 500 mgKOH/g, still more preferably 200 to 500 mgKOH/g, yet still more preferably more than 400 mgKOH/g and 500 mgKOH/g or less, and especially preferably 405 to 500 mgKOH/g. Here, the total base number means one as measured in conformity with the perchloric acid method prescribed in JIS K2501.

The content of the magnesium detergent as converted into a magnesium atom is preferably 50 ppm by mass or more on a basis of the whole amount of the composition. When the content of the magnesium detergent is 50 ppm by mass or more, excellent fuel consumption reducing properties and fast-acting properties of fuel consumption reducing properties revealment are obtained together with the excellent detergency. From the same viewpoints, the content of the magnesium detergent is preferably 50 to 1,500 ppm by mass, more preferably 100 to 1,100 ppm by mass, still more preferably 100 to 750 ppm by mass, and especially preferably 300 to 650 ppm by mass.

As for the content of the magnesium detergent, a mass ratio of a molybdenum atom (Mo) to a magnesium atom (Mg) [Mo/Mg] is required to be 0.1 or more in relation with the aforementioned molybdenum dithiocarbamate (MoDTC). When the foregoing mass ratio is less than 0.1, the fast-acting properties of fuel consumption reducing properties revealment are not obtained. From the viewpoint of obtaining fuel consumption reducing properties and fast-acting properties of fuel consumption reducing properties revealment, the foregoing mass ratio is preferably 0.2 or more, more preferably 0.3 or more, still more preferably 0.7 or more, yet still more preferably more than 1, and especially preferably 1.1 or more. In addition, though an upper limit of the foregoing mass ratio is not particularly limited, it is preferably 4 or less, more preferably 3 or less, and still more preferably 2.5 or less.

In the present invention, though other detergents than the aforementioned calcium detergent and magnesium detergent, for example, a sodium detergent, can also be used, it is preferred that the sodium detergent is not used. When the sodium detergent is not used, the fuel consumption reducing properties and the fast-acting properties of fuel consumption reducing properties revealment can be more improved.

(Boron-Free Succinimide)

From the viewpoint of detergency, it is preferred that the lubricating oil composition of the present invention includes a boron-free succinimide as a dispersant. As the boron-free succinimide, alkenyl succinimides or alkyl succinimides having an alkenyl group or an alkyl group in a molecule thereof are preferably exemplified. Examples thereof include a mono-type represented by the following general formula (2) and a bis-type represented by the following general formula (3).

(2)

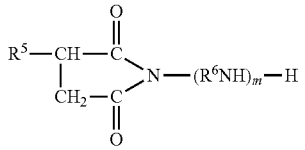

(3)

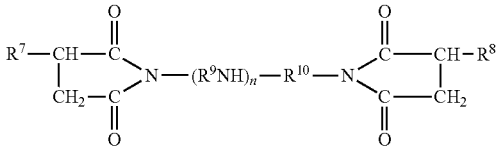

In the general formulae (2) and (3), $R^5$, $R^7$, and $R^8$ each represent an alkenyl group or an alkyl group each having a number average molecular weight of 500 to 4,000, and $R^7$ and $R^8$ may be the same as or different from each other. The number average molecular weight of $R^5$, $R^7$, and $R^8$ is preferably 1,000 to 4,000.

When the number average molecular weight of $R^5$, $R^7$, and $R^8$ is 500 or more, the solubility in the base oil is favorable, whereas when it is 4,000 or less, favorable dispersibility is obtained, and excellent detergency is obtained.

$R^6$, $R^9$, and $W^o$ each represent an alkylene group having 2 to 5 carbon atoms, and $R^9$ and $R^{10}$ may be the same as or different from each other.

m is an integer of 1 to 10, preferably an integer of 2 to 5, and more preferably 3 or 4. When m is 1 or more, the dispersibility is favorable, whereas when it is 10 or less, the solubility in the base oil is also favorable, and excellent detergency is obtained.

n is an integer of 0 to 10, preferably an integer of 1 to 4, and more preferably 2 or 3. When n falls within the aforementioned range, such is preferred from the standpoints of dispersibility and solubility in the base oil, and excellent detergency is obtained.

As the alkenyl group that may be adopted in $R^5$, $R^7$, and $R^8$, a polybutenyl group, a polyisobutenyl group, and an ethylene-propylene copolymer can be exemplified, and as the alkyl group, those obtained through hydrogenation thereof are exemplified. As the polybutenyl group, those obtained through polymerization of a mixture of 1-butene and isobutene or high-purity isobutene are preferably used. Above all, the alkenyl group is preferably a polybutenyl group or an isobutenyl group, and as the alkyl group, those obtained through hydrogenation of a polybutenyl group or an isobutenyl group are exemplified. In the present invention, from the viewpoint of detergency, an alkenyl group is preferred, namely an alkenyl succinimide is preferred.

Examples of the alkylene group that may be adopted in $R^6$, $R^9$, and $R^{10}$ include a methylene group, an ethylene group, an ethylidene group, a trimethylene group, a propylene group, an isopropylene group, a tetramethylene group, a butylene group, an isobutylene group, a pentylene group, a hexamethylene group, a hexylene group, and the like.

The boron-free succinimide can be typically produced by allowing an alkenylsuccinic anhydride that is obtained through a reaction between a polyolefin and maleic anhydride, or an alkylsuccinic anhydride that is obtained through hydrogenation thereof, to react with a polyamine. In addition, a mono-type succinimide compound and a bis-type boron-free succinimide compound can be produced by varying a reaction ratio between the alkenylsuccinic anhydride or alkylsuccinic anhydride and the polyamine.

As an olefin monomer that forms the polyolefin, an α-olefin having 2 to 8 carbon atoms can be used alone or as a mixture of two or more thereof, and a mixture of isobutene and 1-butene is preferred.

Examples of the polyamine include single diamines, such as ethylenediamine, propylenediamine, butylenediamine, pentylenediamine, etc.; polyalkylene polyamines, such as diethylene triamine, triethylene tetramine, tetraethylene pentamine, pentaethylene hexamine, di(methylethylene)triamine, dibutylene triamine, tributylene tetramine, pentapentylene hexamie, etc.; piperazine derivatives, such as aminoethylpiperazine, etc.; and the like.

From the viewpoints of detergency, fuel consumption reducing properties, and fast-acting properties of fuel consumption reducing properties revealment, the content of the boron-free succinimide as converted into a nitrogen atom is required to be less than 1,200 ppm by mass on a basis of the whole amount of the composition. From the same viewpoints, the foregoing content is preferably 100 to 1,000 ppm by mass, more preferably 300 to 900 ppm by mass, still more preferably 400 to 800 ppm by mass, yet still more preferably 400 ppm by mass or more and less than 700 ppm by mass, and especially preferably 400 to 690 ppm by mass.

Furthermore, as the boron-free succinimide, a modified succinimide obtained through a reaction between the compound represented by the general formula (2) or (3) and an alcohol, an aldehyde, a ketone, an alkylphenol, a cyclic carbonate, an epoxy compound, an organic acid, or the like can be used.

(Boron-Containing Succinimide)

From the viewpoints of detergency, fuel consumption reducing properties, and fast-acting properties of fuel consumption reducing properties revealment, it is preferred that the lubricating oil composition of the present invention includes a boron-containing succinimide. As the boron-containing succinimide, those obtained through modification of the aforementioned boron-free succinimide with boron are preferably exemplified. Specifically, the boron-containing succinimide can be, for example, produced by allowing the aforementioned alkenylsuccinic anhydride or alkylsuccinic anhydride that is obtained through a reaction between a polyolefin and maleic anhydride to react with the aforementioned polyamine and boron compound.

Examples of the boron compound include boron oxide, a boron halide, boric acid, boric anhydride, a boric acid ester, an ammonium salt of boric acid, and the like.

From the viewpoints of detergency, fuel consumption reducing properties, and fast-acting properties of fuel consumption reducing properties revealment, the content of the boron-containing succinimide as converted into a boron atom is preferably 50 ppm by mass or more, more preferably 50 to 600 ppm by mass, still more preferably 80 to 500 ppm by mass, yet still more preferably 100 to 400 ppm by mass, especially preferably 120 to 400 ppm by mass, and more especially preferably 220 to 400 ppm by mass on a basis of the whole amount of the composition.

From the viewpoints of detergency and fuel consumption reducing properties, it is preferred that the lubricating oil composition of the present invention includes a boron-containing polybutenyl succinimide, and in particular, a combination of a boron-free polybutenyl succinic acid bisimide and a boron-containing polybutenyl succinimide is preferred.

(Poly(Meth)Acrylate-Based Viscosity Index Improver)

From the viewpoint of fuel consumption reduction, it is preferred that the lubricating oil composition of the present invention further includes a poly(meth)acrylate-based viscosity index improver. By using the poly(meth)acrylate-based viscosity index improver, the viscosity characteristic of the lubricating oil composition is improved, thereby enabling the fuel consumption reducing properties to be improved.

The poly(meth)acrylate-based viscosity index improver may be any of a dispersion type and a non-dispersion type, and one constituted of an alkyl (meth)acrylate having an alkyl group in a molecule thereof is preferred. As the alkyl group in the alkyl (meth)acrylate, a straight-chain alkyl group having 1 to 18 carbon atoms or a branched-chain alkyl group having 3 to 18 carbon atoms is preferably exemplified.

Examples of such a monomer include methyl (meth) acrylate, ethyl (meth)acrylate, propyl (meth)acrylate, butyl (meth)acrylate, pentyl (meth)acrylate, hexyl (meth)acrylate, heptyl (meth)acrylate, octyl (meth)acrylate, nonyl (meth) acrylate, decyl (meth)acrylate, and the like, and two or more of these monomers may also be used as a copolymer. The alkyl group of such a monomer may be either a straight-chain alkyl group or a branched-chain alkyl group.

A weight average molecular weight (Mw) of the poly (meth)acrylate-based viscosity index improver is preferably 10,000 to 1,000,000, more preferably 30,000 to 600,000, still more preferably 320,000 to 600,000, and especially preferably 400,000 to 550,000. A number average molecular weight (Mn) of the poly(meth)acrylate-based viscosity index improver is preferably 10,000 to 1,000,000, and more preferably 30,000 to 500,000. In addition, a molecular weight distribution (Mw/Mn) is preferably 6 or less, more preferably 5 or less, and still more preferably 3.5 or less. When the molecular weight of the poly(meth)acrylate-based viscosity index improver falls within the aforementioned range, excellent fuel consumption reducing properties are obtained. Here, the weight average molecular weight and the number average molecular weight are each a value as measured by GPC and obtained using polystyrene as a calibration curve and in detail, measured under the following conditions.

Column: Two TSK gel GMH6 columns
Measurement temperature: 40° C.
Sample solution: 0.5 mass % THF solution
Detector: Refractive index detector
Standard: Polystyrene The content of the poly(meth)acrylate-based viscosity index improver on a basis of the whole amount of the composition has only to be properly set according to a desired HTHS viscosity and so on, and it is preferably 0.01 to 10.00 mass %, more preferably 0.05 to 5.00 mass %, and still more preferably 0.05 to 2.00 mass %. When the foregoing content falls within the aforementioned range, excellent detergency is obtained together with fuel consumption reducing properties.

Here, the content of the poly(meth)acrylate means the content of only the resin component composed of the poly(meth)acrylate and is, for example, the content on a basis of the solid component, in which the mass of a diluent oil and so on contained together with the poly(meth)acrylate is not included.

It is preferred that the lubricating oil composition of the present invention contains, as the viscosity index improver, a polymer having a structure having a large number of trigeminal branch points from which a linear side chain comes out (the polymer will be hereinafter referred to as "comb-shaped polymer"). Examples of such a comb-shaped polymer include polymers having at least a constituent unit derived from a macromonomer having a polymerizable functional group, such as a (meth)acryloyl group, an ethenyl group, a vinyl ether group, an allyl group, etc. Here, the foregoing constituent unit is corresponding to the "linear side chain".

More specifically, copolymers having a side chain including a constituent unit derived from a macromonomer having the aforementioned polymerizable functional group on a main chain including a constituent unit derived from a vinyl monomer of every kind, such as an alkyl (meth)acrylate, a nitrogen atom-containing monomer, a halogen element-containing monomer, a hydroxyl group-containing monomer, an aliphatic hydrocarbon-based monomer, an alicyclic hydrocarbon-based monomer, an aromatic hydrocarbon-based monomer, etc., are preferably exemplified.

A number average molecular weight (Mn) of the macromonomer is preferably 200 or more, more preferably 300 or more, and still more preferably 400 or more, and preferably 100,000 or less, more preferably 50,000 or less, and still more preferably 10,000 or less.

From the viewpoint of improving the fuel consumption reducing properties, a weight average molecular weight (Mw) of the comb-shaped polymer is preferably 1,000 to 1,000,000, more preferably 5,000 to 800,000, and still more preferably 50,000 to 700,000. A molecular weight distribution (Mw/Mn) is preferably 6 or less, more preferably 5.6 or less, and still more preferably 5 or less; and though a lower limit value thereof is not particularly limited, it is typically 1.01 or more, preferably 1.05 or more, more preferably 1.10 or more, and still more preferably 1.5 or more.

From the viewpoint of improving the fuel consumption reducing properties, the content of the comb-shaped polymer is preferably 0.1 to 20 mass %, more preferably 0.5 to 10 mass %, and still more preferably 1 to 8 mass % on a basis of the whole amount of the composition. Here, the content of the comb-shaped polymer means the content of only the resin component composed of the comb-shaped polymer and is, for example, the content on a basis of the solid component, in which the mass of a diluent oil and so on contained together with the comb-shaped polymer is not included.

The lubricating oil composition of the present invention may also include other viscosity index improvers than the aforementioned poly(meth)acrylate and comb-shaped polymer, for example, an olefin-based copolymer (for example, an ethylene-propylene copolymer, etc.), a dispersion type olefin-based copolymer, or a styrene-based copolymer (for example, a styrene-diene copolymer, a styrene-isoprene copolymer, etc.).

From the viewpoint of improving the detergency of the lubricating oil composition, in the viscosity index improver that is used in the present invention, the content of the poly(meth)acrylate and/or the comb-shaped polymer that is preferably used is preferably 70 to 100 mass %, more preferably 80 to 100 mass %, and still more preferably 90 to 100 mass % relative to the whole amount (100 mass %) of the solid component in the viscosity index improver.

(Anti-Wear Agent)

From the viewpoint of improving the fuel consumption reducing properties and anti-wear characteristic, it is preferred that the lubricating oil composition of the present invention includes an anti-wear agent or an extreme pressure agent. Examples of the anti-wear agent or extreme pressure agent include organic zinc compounds, such as zinc phosphate, a zinc dialkyldithiophosphate (ZnDTP), zinc dithiocarbamate (ZnDTC), etc.; sulfur-containing compounds, such as disulfides, sulfurized olefins, sulfurized oils and fats, sulfurized esters, thiocarbonates, thiocarbamates, polysulfides, etc.; phosphorus-containing compounds, such as phosphite esters, phosphate esters, phosphonate esters, and amine salts or metal salts thereof, etc.; and sulfur- and phosphorus-containing anti-wear agents, such as thiophosphite esters, thiophosphate esters, thiophosphonate esters, and amine salts or metal salts thereof, etc. These anti-wear agents can be used alone or in combination of any two or more thereof. Of those, a zinc dialkyldithiophosphate (ZnDTP) is preferred.

Examples of the zinc dialkyldithiophosphate (ZnDTP) include a compound represented by the following general formula (4).

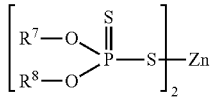

(4)

In the general formula (4), $R^7$ and $R^8$ each independently represent a primary or secondary alkyl group having 3 to 22 carbon atoms or an alkylaryl group substituted with an alkyl group having 3 to 18 carbon atoms.

Here, examples of the primary or secondary alkyl group having 3 to 22 carbon atoms include a primary or secondary propyl group, a primary or secondary butyl group, a primary or secondary pentyl group, a primary or secondary hexyl group, a primary or secondary heptyl group, a primary or secondary octyl group, a primary or secondary nonyl group, a primary or secondary decyl group, a primary or secondary dodecyl group, a primary or secondary tetradecyl group, a primary or secondary hexadecyl group, a primary or secondary octadecyl group, a primary or secondary eicosyl group, and the like. Examples of the alkylaryl group substituted with an alkyl group having 3 to 18 carbon atoms include a propylphenyl group, a pentylphenyl group, an octylphenyl group, a nonylphenyl group, a dodecylphenyl group, and the like.

In the case of using a zinc dialkyldithiophosphate (ZnDTP), the compound represented by the general formula (4) can be used alone or in combination of plural kinds thereof; however, it is preferred to use at least a zinc primary dialkyldithiophosphate (primary alkyl ZnDTP) having a primary alkyl group, and it is more preferred to use a primary alkyl ZnDTP alone. In the case of using a combination of a primary alkyl ZnDTP and a zinc secondary dialkyldithiophosphate (secondary alkyl ZnDTP) having a secondary alkyl group, a mass blending ratio of the primary alkyl ZnDTP to the secondary alkyl ZnDTP is preferably 1/3 to 1/15, more preferably 1/4 to 1/10, and still more preferably 1/6 to 1/10.

In the case of using a zinc dialkyldithiophosphate (ZnDTP) as the anti-wear agent, the content of ZnDTP as converted into a phosphorus atom is preferably 100 to 2,000 ppm by mass, more preferably 300 to 1,500 ppm by mass, still more preferably 500 to 1,000 ppm by mass, and especially preferably 600 to 840 ppm by mass on a basis of the whole amount of the composition.

(Antioxidant)

It is preferred that the lubricating oil composition of the present invention includes an antioxidant. Examples of the antioxidant include an amine-based antioxidant, a phenol-based antioxidant, a molybdenum-based antioxidant, a sulfur-based antioxidant, a phosphorus-based antioxidant, and the like.

Examples of the amine-based antioxidant include diphenylamine-based antioxidants, such as diphenylamine, an alkylated diphenylamine having an alkyl group having 3 to 20 carbon atoms, etc.; naphthylamine-based antioxidants, such as α-naphthylamine, a $C_3$-$C_{20}$-alkyl-substituted phenyl-α-naphthylamine, etc.; and the like.

Examples of the phenol-based antioxidant include monophenol-based antioxidants, such as 2,6-di-tert-butyl-4-methylphenol, 2,6-di-tert-butyl-4-ethylphenol, octadecyl-3-(3,5-di-tert-butyl-4-hydroxyphenyl)propionate, etc.; diphenol-based antioxidants, such as 4,4'-methylenebis(2,6-di-tert-butylphenol), 2,2'-methylenebis(4-ethyl-6-tert-butylphenol), etc.; hindered phenol-based antioxidants; and the like.

Examples of the molybdenum-based antioxidant include a molybdenum amine complex resulting from a reaction of molybdenum trioxide and/or molybdic acid and an amine compound; and the like.

Examples of the sulfur-based antioxidant include dilauryl-3,3'-thiodipropionate and the like.

Examples of the phosphorus-based antioxidant include a phosphite and the like.

Though these antioxidants may be used alone or in combination of plural kinds thereof, in general, the use of a combination of plural kinds thereof is preferred.

The content of the antioxidant is preferably 0.01 to 3 mass %, and more preferably 0.1 to 2 mass % on a basis of the whole amount of the composition. In the case of using an amine-based antioxidant as the antioxidant, its content as converted into a nitrogen atom is preferably 50 to 1,500 ppm by mass, more preferably 100 to 1,000 ppm by mass, still more preferably 150 to 800 ppm by mass, and especially preferably 200 to 600 ppm by mass on a basis of the whole amount of the composition.

(Pour-Point Depressant)

It is preferred that the lubricating oil composition of the present invention includes a pour-point depressant. Examples of the pour-point depressant include, in addition to the aforementioned polymethacrylate, an ethylene-vinyl acetate copolymer, a condensate of a chlorinated paraffin and naphthalene, a condensate of a chlorinated paraffin and phenol, a polyalkylstyrene, a poly(meth)acrylate, and the like.

A weight average molecular weight (Mw) of the pour-point depressant is preferably 20,000 to 100,000, more preferably 30,000 to 80,000, and still more preferably 40,000 to 60,000. A molecular weight distribution (Mw/Mn) is preferably 5 or less, more preferably 3 or less, and still more preferably 2 or less.

The content of the pour-point depressant may be properly determined according to a desired MRV viscosity or the like, and it is preferably 0.01 to 5 mass %, and more preferably 0.02 to 2 mass %.

(Friction Modifier)

From the viewpoint of improving the fuel consumption reducing properties and anti-wear characteristic, the lubricating oil composition of the present invention may include a friction modifier other than the aforementioned molybdenum dithiocarbamate (MoDTC). As the friction modifier, those which are generally used as a friction modifier of a lubricating oil composition can be used without limitations. Examples thereof include ashless friction modifiers having at least one alkyl group or alkenyl group having 6 to 30 carbon atoms, especially a straight-chain alkyl group or straight-chain alkenyl group having 6 to 30 carbon atoms in a molecule thereof, such as an aliphatic amine, a fatty acid ester, a fatty acid amide, a fatty acid, an aliphatic alcohol, an aliphatic ether, etc.; molybdenum friction modifiers, such as molybdenum dithiophosphate (MoDTP), an amine salt of molybdic acid, etc.; and the like, and these friction modifiers can be used alone or in combination of plural kinds thereof.

In the case of using an ashless friction modifier, its content is preferably 0.01 to 3 mass %, and more preferably 0.1 to 2 mass % on a basis of the whole amount of the composition. In the case of using other molybdenum friction modifier than the molybdenum dithiocarbamate (MoDTC), its content as converted into a molybdenum atom is preferably 60 to 1,000 ppm by mass, more preferably 80 to 1,000 ppm by mass, still more preferably more than 100 ppm by mass and 900 ppm by mass or less, and especially preferably 110 to 800 ppm by mass on a basis of the whole amount of the composition. When the content falls within the aforementioned range, excellent fuel consumption reducing properties and anti-wear characteristic are obtained, and a lowering of detergency can be suppressed.

In the case of using a molybdenum dithiocarbamate (MoDTC) in combination with other molybdenum friction modifier, a proportion of the molybdenum dithiocarbamate (MoDTC) as converted into a molybdenum atom, relative to the total amount of the molybdenum dithiocarbamate (MoDTC) and the other molybdenum friction modifier is preferably more than 50 mass %, more preferably 60 mass % or more, still more preferably 80 mass % or more, and especially preferably 90 mass % or more. Though an upper limit thereof is not particularly limited, it is preferably less than 100 mass %, and more preferably 99 mass % or less. In the case of using a molybdenum dithiocarbamate (MoDTC) in combination with other molybdenum friction modifier, the proportion of the molybdenum dithiocarbamate (MoDTC) falls within the aforementioned range; however, in the present invention, it is preferred that the molybdenum dithiocarbamate (MoDTC) is used without being used in combination with other molybdenum friction modifier.

(General-Purpose Additive)

The lubricating oil composition of the present invention may further contain a general-purpose additive, if desired within the range where the effects of the present invention are not impaired. Examples of the general-purpose additive include a rust preventive, a metal deactivator, a defoaming agent, an extreme pressure agent, and the like.

Examples of the rust preventive include a petroleum sulfonate, an alkylbenzene sulfonate, a dinonylnaphthalene sulfonate, an alkenylsuccinic ester, a polyhydric alcohol ester, and the like.

Examples of the metal deactivator include a benzotriazole-based compound, a tolyltriazole-based compound, a thiadiazole-based compound, an imidazole-based compound, a pyrimidine-based compound, and the like.

Examples of the defoaming agent include silicone oil, fluorosilicone oil, a fluoroalkyl ether, and the like.

Examples of the extreme pressure agent include sulfur-based extreme pressure agents, such as sulfides, sulfoxides, sulfones, thiophosphinates, etc.; halogen-based extreme pressure agents, such as a chlorinated hydrocarbon, etc.; organic metal-based extreme pressure agents; and the like.

The content of such a general-purpose additive can be properly regulated within the range where the effects of the present invention are not impaired, and it is typically 0.001 to 10 mass %, and preferably 0.005 to 5 mass % on a basis of the whole amount of the composition. The total content of these general-purpose additives is preferably 20 mass % or less, more preferably 10 mass % or less, still more preferably 5 mass % or less, and yet still more preferably 2 mass % or less on a basis of the whole amount of the composition.

(Application of Lubricating Oil Composition)

The lubricating oil composition of the present invention can be used for lubrication of a gasoline engine, a diesel engine, and besides, various industrial internal combustion engines, and so on, and it is suitably used for a gasoline engine, especially a gasoline engine mounted with a direct injection supercharger. When using for such an application, a performance capable of revealing fuel consumption reducing properties due to a friction reducing effect within a short period of time (fast-acting properties of fuel consumption reducing properties revealment) while having excellent fuel consumption reducing properties which the lubricating oil composition of the present invention has can be effectively applied.

(Production Method of Lubricating Oil Composition)

The production method of a lubricating oil composition of the present invention includes blending a base oil with a molybdenum dithiocarbamate, a calcium detergent, a magnesium detergent, and a boron-free succinimide, such that the content of the molybdenum dithiocarbamate as converted into a molybdenum atom is 1,200 ppm by mass or less on a basis of the whole amount of the composition; the content of the boron-free succinimide as converted into a nitrogen atom is less than 1,200 ppm by mass on a basis of the whole amount of the composition; and a mass ratio of the molybdenum atom (Mo) to a magnesium atom (Mg) of the magnesium detergent [Mo/Mg] is 0.1 or more.

If desire, the lubricating oil composition of the present invention can be produced by blending other components, for example, a boron-containing succinimide, a poly(meth) acrylate, a viscosity index improver, an anti-wear agent, an antioxidant, a pour-point depressant, a friction modifier, and besides, general-purpose additives. The amount (blending amount) of each of these components to be blended may be properly selected and determined according to the desired performance within the range of the content of each of the components as described above.

Each of the aforementioned components may be blended in the base oil by any method, and its technique is not limited thereto. For example, after separately mixing the molybdenum dithiocarbamate, the calcium detergent, the magnesium detergent, and the boron-free succinimide, and furthermore, other additives, this mixture may be blended in the base oil, or these materials may be successively added to and mixed in the base oil. In the latter case, the addition order does not matter.

EXAMPLES

The present invention is hereunder described in more detail by reference to Examples, but it should be construed that the present invention is by no means limited by these Examples. The content of each of atoms of lubricating oil compositions prepared in the Examples and Comparative Examples was measured and evaluated by the following methods.

[Content of Each of Atoms of Lubricating Oil Composition]

(Contents of Boron Atom, Calcium Atom, Potassium Atom, Molybdenum Atom, and Phosphorus Atom)

The measurement was performed in conformity with JIS-5S-38-92.

(Content of Nitrogen Atom)

The measurement was performed in conformity with JIS K2609.

Examples 1 to 8 and Comparative Examples 1 to 3

In Examples 1 to 8, a base oil and various additives of the kinds and blending amounts shown in Table 1 were blended, and in Comparative Examples 1 to 3, a base oil and various additives of the kinds and blending amounts shown in Table 2 were blended, thereby preparing lubricating oil compositions, respectively.

(Evaluation of Fast-Acting Properties of Fuel Consumption Reducing Properties Revealment)

With respect to these lubricating oil compositions thus prepared, the following measurement of a friction coefficient (HFRR test) was performed to measure a time (seconds) until the friction coefficient became less than 0.10, thereby evaluating the fast-acting properties of fuel consumption reducing properties revealment. The results are shown in Tables 1 and 2.

(Measurement of Friction Coefficient (HFRR Test))

Using an HFRR tester (manufactured by PCS Instruments), the friction coefficient of each of the lubricating oil compositions prepared in the Examples and Comparative Examples was measured, thereby measuring a time (seconds) until the friction coefficient became less than 0.10. It may be said that the shorter the time (seconds) until the friction coefficient became less than 0.10, the more excellent the fast-acting properties of fuel consumption reducing properties revealment. The foregoing time was evaluated according to the following criteria.

A: The time was 200 seconds or shorter.

B: The time was longer than 200 seconds and 250 seconds or shorter.

C: The time was longer than 250 seconds.

Test piece: (A) Ball=HFRR standard test piece (AISI 52100 material), (B) Disc=HFRR standard test piece (AISI 52100 material)

Amplitude: 1.0 mm

Frequency: 50 Hz

Load: 5 g

Temperature: 80° C.

TABLE 1

| | | | Example | | | | | | | |
|---|---|---|---|---|---|---|---|---|---|---|
| | | | 1 | 2 | 3 | 4 | 5 | 6 | 7 | 8 |
| Composition | Base oil A | — | Balance | Balance | Balance | Balance | Balance | Balance | Balance | Balance |
| | Base oil B | mass % | 10.00 | 10.00 | 10.00 | 10.00 | 10.00 | 10.00 | 10.00 | 10.00 |
| | Detergent A | mass % | 0.81 | 0.81 | 0.81 | 0.81 | 0.81 | 0.81 | 1.62 | 0.81 |
| | Detergent B | mass % | 0.54 | 0.21 | 1.07 | 2.14 | 0.54 | 0.54 | 0.54 | 0.54 |
| | Detergent C | mass % | — | — | — | — | — | — | — | — |
| | MoDTC | mass % | 0.40 | 0.40 | 0.40 | 0.40 | 0.30 | 1.00 | 0.40 | 0.40 |
| | Dispersant A | mass % | 6.00 | 6.00 | 6.00 | 6.00 | 6.00 | 6.00 | 6.00 | 6.00 |
| | Dispersant B | mass % | 2.00 | 2.00 | 2.00 | 2.00 | 2.00 | 2.00 | 2.00 | — |
| | Viscosity index improver | mass % | 5.60 | 5.60 | 5.60 | 5.60 | 5.60 | 5.60 | 5.60 | 5.60 |
| | Pour-point depressant | mass % | 0.20 | 0.20 | 0.20 | 0.20 | 0.20 | 0.20 | 0.20 | 0.20 |
| | Others | mass % | 3.10 | 3.10 | 3.10 | 3.10 | 3.10 | 3.10 | 3.10 | 3.10 |
| Properties | Detergent A | ppmCa | 1000 | 1000 | 1000 | 1000 | 1000 | 1000 | 2000 | 1000 |
| | Detergent B | ppmMg | 500 | 200 | 1000 | 2000 | 500 | 500 | 500 | 500 |
| | Detergent C | ppmNa | — | — | — | — | — | — | — | — |
| | MoDTC | ppmMo | 400 | 400 | 400 | 400 | 300 | 1000 | 400 | 400 |
| | Mo/Mg | — | 0.8 | 2.0 | 0.4 | 0.2 | 0.6 | 2.0 | 0.8 | 0.8 |
| | Dispersant A | ppmN | 600 | 600 | 600 | 600 | 600 | 600 | 600 | 600 |
| | Dispersant B | ppmN | 250 | 250 | 250 | 250 | 250 | 250 | 250 | 0 |
| | | ppmB | 260 | 260 | 260 | 260 | 260 | 260 | 260 | 0 |
| | ZnDTP | ppmP | 800 | 800 | 800 | 800 | 800 | 800 | 800 | 800 |
| Evaluation | HFRR measured time (sec) | | 180 | 142 | 190 | 210 | 246 | 121 | 167 | 248 |
| | Evaluation of fast-acting properties of fuel consumption reducing properties revealment | | A | A | A | B | B | A | A | B |

TABLE 2

| | | | Comparative Example | | |
|---|---|---|---|---|---|
| | | | 1 | 2 | 3 |
| Composition | Base oil A | — | Balance | Balance | Balance |
| | Base oil B | mass % | 10.00 | 10.00 | 10.00 |
| | Detergent A | mass % | 0.81 | 0.81 | 0.81 |
| | Detergent B | mass % | — | — | 0.54 |
| | Detergent C | mass % | 0.26 | — | — |
| | MoDTC | mass % | 0.40 | 0.40 | 0.40 |
| | Dispersant A | mass % | 6.00 | 6.00 | 12.00 |
| | Dispersant B | mass % | 2.00 | 2.00 | 2.00 |
| | Viscosity index improver | mass % | 5.60 | 5.60 | 5.60 |
| | Pour-point depressant | mass % | 0.20 | 0.20 | 0.20 |
| | Others | mass % | 3.10 | 3.10 | 3.10 |
| Properties | Detergent A | ppmCa | 1000 | 1000 | 1000 |
| | Detergent B | ppmMg | — | — | 500 |
| | Detergent C | ppmNa | 500 | — | — |
| | MoDTC | ppmMo | 400 | 400 | 400 |
| | Mo/Mg | — | — | — | 0.8 |
| | Dispersant A | ppmN | 600 | 600 | 1200 |
| | | ppmN | 250 | 250 | 250 |
| | Dispersant B | ppmB | 260 | 260 | 260 |
| | ZnDTP | ppmP | 800 | 800 | 800 |
| Evaluation | HFRR measured time (sec) | | 688 | 618 | 713 |
| | Evaluation of fast-acting properties of fuel consumption reducing properties revealment | | C | C | C |

(Note) The abbreviations and materials used, and so on in Tables 1 and 2 are as follows.

ppmCa, ppmMg, ppmNa, ppmP, ppmN, and ppmB express the contents (ppm by mass) as converted into a calcium atom (Ca), a magnesium atom (Mg), a sodium atom (Na), a phosphorus atom (P), a nitrogen atom (N), and a boron atom (B), respectively. In addition, ZnDTP expresses a zinc dialkyldithiophosphate included in the other additives.

*1: Mo/Mg expresses a mass ratio of the molybdenum atom (Mo) to the magnesium atom (Mg) [Mo/Mg].

The base oils and various additives used for preparing the lubricating oil composition of each of the Examples and Comparative Examples shown in Tables 1 and 2 are as follows.

Base oil A: Mineral oil classified into Group 3 of the API base stock categories, kinematic viscosity at 100° C.: 4.07 $mm^2/s$, viscosity index: 131, % $C_A$: −0.4, % $C_N$: 12.8, % $C_P$: 87.6

Base oil B: Synthetic oil (poly-α-olefin (PAO), kinematic viscosity at 100° C.: 5.1 $mm^2/s$, viscosity index: 143)

Detergent A: Overbased calcium salicylate, base number (by the perchloric acid method): 350 mgKOH/g, calcium content: 12 mass %

Detergent B: Overbased magnesium sulfonate, base number (by the perchloric acid method): 410 mgKOH/g, magnesium content: 9.4 mass %, sulfur content: 2.0 mass %

Detergent C: Overbased sodium sulfonate, base number (by the perchloric acid method): 450 mgKOH/g, sodium content: 20 mass %, sulfur content: 1.2 mass % MoDTC: Molybdenum dithiocarbamate (molybdenum content: 10 mass %)

Dispersant A: Boron-free succinimide (polybutenyl succinic acid bisimide), nitrogen content: 1 mass %

Dispersant B: Boron-containing succinimide (boron-containing polybutenyl succinic acid bisimide), nitrogen content: 1.2 mass %, boron content: 1.3 mass %

Viscosity index improver: A viscosity index improver including, as a resin component, a comb-shaped polymer having at least a constituent unit derived from a macromonomer having an Mn of 500 or more (Mw=420,000, Mw/Mn=5.92) and having a resin component concentration of 19 mass %.

Pour-point depressant: Polymethacrylate (PMA, Mw=50,000, Mn=30,000, Mw/Mn=1.7, resin component concentration: 66 mass %)

Others: Zinc dialkyldithiophosphate (primary alkyl ZnDTP), hindered phenol-based antioxidant, diphenylamine-based antioxidant, defoaming agent, and metal deactivator As shown in Table 1, it was confirmed that the lubricating oil compositions of the Examples have excellent fast-acting properties of fuel consumption reducing properties revealment capable of revealing the fuel consumption reducing properties due to a friction reducing effect within a short period of time such that the time until the friction coefficient becomes less than 0.10 is 250 seconds or less, and furthermore, excellent fast-acting properties of fuel consumption reducing properties revealment such that the time until the friction coefficient becomes less than 0.10 is 200 seconds or less, while having excellent fuel consumption reducing properties.

On the other hand, as shown in Table 2, in the lubricating oil composition of Comparative Example 1 using the sodium detergent in place of the molybdenum detergent, the lubricating oil composition of Comparative Example 2 not including the molybdenum detergent and the sodium detergent, and the lubricating oil composition of Comparative Example 3 not containing the boron-free succinimide, the time until the friction coefficient becomes less than 0.10 is more than 600 seconds, and hence, it was confirmed that all of these lubricating oil compositions are inferior in the fast-acting properties of fuel consumption reducing properties revealment.

The invention claimed is:

1. A method, comprising:

lubricating a gasoline engine with a lubricating oil composition, wherein the lubricating oil composition comprises:

a base oil;

a molybdenum dithiocarbamate;

a calcium detergent comprising a calcium salicylate;

a magnesium detergent comprising a magnesium sulfonate;

a boron-free succinimide; and a boron-containing succinimide, wherein:

a content of the base oil in the lubricating oil composition is 70 mass % or more relative to the whole amount of the lubricating oil composition;

a content of the molybdenum dithiocarbamate in the lubricating oil composition as converted into a molybdenum atom is from 400 to 1,000 ppm by mass on a basis of a whole amount of the lubricating oil composition;

only the calcium salicylate is present as the calcium detergent and a content of the calcium detergent in the lubricating oil composition as converted into a calcium atom is from 1,000 to 2,000 ppm by mass a basis of the whole amount of the lubricating oil composition, only the magnesium sulfonate is present as the magnesium detergent and a content of the magnesium detergent in the lubricating oil composition as converted into a magnesium atom is from 200 to 1,000 ppm by mass on a basis of the whole amount of the lubricating oil composition;

a content of the boron-free succinimide in the lubricating oil composition as converted into a nitrogen atom is 690 ppm by mass or less on a basis of the whole amount of the lubricating oil composition;

a content of the boron-containing succinimide in the lubricating oil composition as converted into a boron atom is from 220 to 600 ppm by mass on a basis of the whole amount of the lubricating oil composition;

a mass ratio of the molybdenum atom (Mo) to a magnesium atom (Mg) of the magnesium detergent [Mo/Mg] in the lubricating oil composition is 0.4 or more; and wherein a time until the friction coefficient becomes less than 0.10 of the lubricating oil composition is 200 seconds or shorter, as measured with an HFRR tester equipped with a ball comprised of an AISI 52100 material and a disc comprised of an AISI 52100 material at an amplitude of 1.0 mm, a frequency of 50 Hz, a load of 5 g, and at temperature of 80° C.

2. The method according to claim 1, wherein the lubricating oil composition further comprises a poly(meth)acrylate-based viscosity index improver.

3. The method according to claim 1, wherein the lubricating oil composition does not include a sodium detergent.

4. The method according to claim 1, wherein the base oil of the lubricating oil composition is at least one selected from a mineral oil and a synthetic oil which are classified into Groups 3 to 5 of the base stock categories of the API (American Petroleum Institute).

5. The method according to claim 1, wherein the lubricating oil composition has a kinematic viscosity at 100° C. of 3.8 to 12.5 $mm^2/s$.

6. The method according to claim 1, wherein the gasoline engine is mounted with a direct injection supercharger.

7. The method according to claim 1, wherein the content of the boron-free succinimide in the lubricating oil composition as converted into a nitrogen atom is 600 ppm or less by mass on a basis of the whole amount of the lubricating oil composition.

8. A lubricating oil composition, comprising:

a base oil;

a molybdenum dithiocarbamate;

a calcium detergent comprising a calcium salicylate;

a magnesium detergent comprising a magnesium sulfonate;

a boron-free succinimide; and a boron-containing succinimide, wherein:

a content of the base oil in the lubricating oil composition is 70 mass % or more relative to the whole amount of the lubricating oil composition;

a content of the molybdenum dithiocarbamate in the lubricating oil composition as converted into a molybdenum atom is from 400 to 1,000 ppm by mass on a basis of the whole amount of the lubricating oil composition;

only the calcium salicylate is present as the calcium detergent and a content of the calcium detergent in the lubricating oil composition as converted into a calcium atom is from 1,000 to 2,000 ppm by mass on a basis of the whole amount of the lubricating oil composition, only the magnesium sulfonate is present as the magnesium detergent and a content of the magnesium detergent in the lubricating oil composition as converted into a magnesium atom is from 200 to 1,000 ppm by mass on a basis of the whole amount of the lubricating oil composition;

a content of the boron-free succinimide in the lubricating oil composition as converted into a nitrogen atom is 690 ppm by mass or less on a basis of the whole amount of the lubricating oil composition;

a content of the boron-containing succinimide in the lubricating oil composition as converted into a boron atom is from 220 to 600 ppm by mass on a basis of the whole amount of the lubricating oil composition;

a mass ratio of the molybdenum atom (Mo) to a magnesium atom (Mg) of the magnesium detergent [Mo/Mg] in the lubricating oil composition is 0.4 or more; and wherein a time until the friction coefficient becomes less than 0.10 of the lubricating oil composition is 200 seconds or shorter, as measured with an HFRR tester equipped with a ball comprised of an AISI 52100 material and a disc comprised of an AISI 52100 material at an amplitude of 1.0 mm, a frequency of 50 Hz, a load of 5 g, and at temperature of 80° C.

9. The lubricating oil composition according to claim 8, further comprising a poly(meth)acrylate-based viscosity index improver.

10. The lubricating oil composition according to claim 8, wherein the lubricating oil composition does not include a sodium detergent.

11. The lubricating oil composition according to claim 8, wherein the base oil is at least one selected from a mineral oil and a synthetic oil which are classified into Groups 3 to 5 of the base stock categories of the API (American Petroleum Institute).

12. The lubricating oil composition according to claim 8, having a kinematic viscosity at 100° C. of 3.8 to 12.5 $mm^2/s$.

13. The lubricating oil composition according to claim 8, wherein the content of the boron-free succinimide in the lubricating oil composition as converted into a nitrogen atom is less than 600 ppm by mass on a basis of the whole amount of the lubricating oil composition.

14. The method of claim 1, wherein the lubricating oil composition further comprises a zinc dialkyldithiophosphate, wherein a content of the zinc dialkyldithiophosphate in the lubricating oil composition as converted into a phosphorous atom is from 100 to 2,000 ppm by mass on a basis of the whole amount of the lubricating oil composition.

15. The lubricating oil composition according to claim 8, further comprising a zinc dialkyldithiophosphate, wherein a content of the zinc dialkyldithiophosphate in the lubricating oil composition as converted into a phosphorous atom is from 100 to 2,000 ppm by mass on a basis of the whole amount of the lubricating oil composition.

16. The method of claim 1, wherein the content of the boron-containing succinimide in the lubricating oil composition as converted into a boron atom is from 220 to 400 ppm by mass on a basis of the whole amount of the lubricating oil composition.

17. The lubricating oil composition according to claim 8, wherein the content of the boron-containing succinimide in the lubricating oil composition as converted into a boron atom is from 220 to 400 ppm by mass on a basis of the whole amount of the lubricating oil composition.

18. The method of claim 1, wherein the content of the boron-containing succinimide in the lubricating oil composition as converted into a boron atom is from 220 to 500 ppm by mass on a basis of the whole amount of the lubricating oil composition.

19. The lubricating oil composition according to claim 8, wherein the content of the boron-containing succinimide in the lubricating oil composition as converted into a boron atom is from 220 to 500 ppm by mass on a basis of the whole amount of the lubricating oil composition.

* * * * *